US005819982A

United States Patent [19]

Brown

[11] Patent Number: 5,819,982

[45] Date of Patent: Oct. 13, 1998

[54] DISPENSER FOR DISPOSABLE LIDS

[76] Inventor: Anthony P. Brown, Rt. 1, Box 466, Cadet, Mo. 63630

[21] Appl. No.: 792,699

[22] Filed: Jan. 29, 1997

[51] Int. Cl.[6] ..... B65G 59/00

[52] U.S. Cl. ..... 221/226; 221/289; 221/312 R

[58] Field of Search ..... 221/226, 232, 221/289, 290, 292, 36, 33, 59, 63, 228, 312 R

[56] References Cited

U.S. PATENT DOCUMENTS

| | | | |
|---|---|---|---|
| 3,058,617 | 10/1962 | Carter et al. | 221/223 |
| 3,100,583 | 8/1963 | Erickson | 221/36 |
| 3,122,267 | 2/1964 | Edwards | 221/1 |
| 3,864,898 | 2/1975 | West | 53/328 |
| 5,012,952 | 5/1991 | Franz | 221/36 |
| 5,038,969 | 8/1991 | Berger | 221/40 |
| 5,131,562 | 7/1992 | Brown | 221/41 |
| 5,322,188 | 6/1994 | Dodaro | 221/223 |
| 5,328,052 | 7/1994 | Kizilos | 221/42 |
| 5,383,571 | 1/1995 | Gunderson | 221/223 |
| 5,427,273 | 6/1995 | Vine | 221/221 |

*Primary Examiner*—H. Grant Skaggs
*Assistant Examiner*—Khoi H. Tran
*Attorney, Agent, or Firm*—Grace J. Fishel

[57] ABSTRACT

A dispenser for dispensing disposable lids from a coaxial stack of nested lids. The dispenser has a v-shaped tray with an open dispensing end for holding the stack, a resilient member biasing the lids towards the open dispensing end and a pair of spaced apart friction surfaces opposing the tray at the open dispensing end. The friction surfaces are inclined at a low angle to the stack and overhang the tray forming a throat through which the lids pass. As the lids are pushed into the throat by the resilient member biasing the lids, the friction surfaces stop movement of the stack through the throat and an endmost of the lids is unlatched from a next-to-endmost lid opposite the friction surfaces. A curved finger followed by a stop is reciprocated between the friction surfaces. When the finger is reciprocated towards the stack of lids, it makes contact with the endmost flange, overriding and hooking under its flange. The finger is stopped between the endmost lid and the next-to-endmost lid by the stop pressing against the endmost lid. When the finger is then reciprocated away from the stack of lids, the endmost lid is separated from the next-to-endmost lid and kept on the finger by the stop as the endmost lid is slid along the friction surfaces, whereafter the endmost lid slides off the finger.

10 Claims, 6 Drawing Sheets

10
60
78
70
72
86
56
72
70
12
60

46
50
34
44
38
42
18
52
24
54
40
28
32
32
66
30
48
26
22
20
84
82
86
78
80
68
60
70
72
58
88
56
62
64
10

DISPENSER FOR DISPOSABLE LIDS

BACKGROUND OF THE INVENTION

1. Field of the Invention

The present invention relates to a dispenser adapted for serially dispensing disposable lids for soft drinks or the like from a coaxial stack of nested lids.

2. Brief Description of the Prior Art

In fast food restaurants and convenience markets, beverages such as soft drinks or the like are typically served in paper or plastic cups, which, to prevent spilling, are provided with molded plastic lids. These lids have a resilient flange which snaps into engagement with a bead formed in the lip of the beverage container. Individual cup dispensers have long been available which permit the removal of a single cup without contamination or disturbance of the remaining supply. Container lids, however, differ from cups in that no deep graspable surface is provided.

Disposable lids have generally been presented for use in open, horizontal trays. In such trays, the elongated stack of lids generally rests with its longitudinal axis disposed horizontally within the tray. This presentation makes it difficult to grasp and separate a single lid from the stack without contaminating and disturbing the remainder of the lids. To pick out a lid, a consumer often must use two hands. This process entails touching and possibly contaminating the remaining lids in the tray. In addition, with frequent handling of the lids, the tray often becomes cluttered with loose lids that have been dislodged from the stack. From time to time, the display must be rearranged by store personnel and the loose lids are often thrown away, resulting in considerable waste.

The above-mentioned problems with the storage and presentation of disposable lids has led many establishments to keep the lids behind a service counter. When this practice is adopted, the lids must be dispensed by service personnel, which reduces but does not eliminate contamination problems. In addition, this method of dispensing disposable lids makes it more difficult to render fast service and defeats the objectives of self-service.

There have been dispensers proposed for serially dispensing plastic lids in a manner that isolates the remainder of the stack of lids from the user, but none has been highly effective, as evidenced by their absence from the market. Simple dispensers like that shown in U.S. Pat. No. 5,012,952 to Franz fail to take account of the tendency of the lids to latch together opposite where they are being picked apart. Some dispensers like that shown in U.S. Pat. No. 5,038,969 to Berger do not work when the lids are appreciably nested, as is typically the case with disposable lids to reduce volume for shipping and storing. Other dispensers are too mechanically complicated, being expensive or requiring frequent adjustments to prevent jamming.

SUMMARY OF THE INVENTION

In view of the above, it is an object of the present invention to provide a dispenser for serially dispensing disposable lids from a coaxial stack of nested lids in a manner that isolates the remainder of the stack from the lid being dispensed. It is another object to provide a dispenser which is relatively simple, usable with different sized lids and does not jam in ordinary use. Other objects and features of the invention will be in part apparent and in part point out hereinafter.

A main feature of the present invention is to provide a dispenser adapted for serially dispensing disposable lids from a coaxial stack of nested lids of the kind having a circular top wall and an outwardly flared annular flange. In major part, the dispenser has a V-shaped tray that is adapted to receive the stack of lids with an endmost lid and a next-to-endmost lid at an open dispensing end. A resilient member is provided for biasing the lids in the V-shaped elongated tray toward the open dispensing end.

A pair of spaced apart elongated friction surfaces are positioned opposite the tray at the open dispensing end. The friction surfaces are inclined at an angle to the stack of nested lids and overhang a portion of the tray, forming a throat at the open dispensing end through which the lids pass. The friction surfaces make tangential contact with the outwardly flared annular flange of the endmost lid and several of the following lids in the stack. The friction surfaces stop movement of the stack of lids, while the endmost of the lids is unlatched from the next-to-endmost lid opposite the friction surfaces under force of the resilient member biasing the lids.

A curved finger followed by a stop is mounted on a member reciprocating the finger and the stop between the friction surfaces. When the finger is reciprocated towards the stack of nested lids by the reciprocating member, the finger makes tangential contact with the outwardly flared flange of the endmost lid and overrides and hooks under the flange. Further rearward movement of the finger over the next-to-endmost lid is prevented by the stop which comes to rest against the endmost lid. As the finger is reciprocated away from the stack of nested lids, the endmost lid is separated from the next-to-endmost lid by the finger as the lid is slid along the friction surfaces. Once separation is complete, the lid slides off the finger into a dispensing tray or the like provided at the open dispensing end and the stack of lids is advanced along the V-shaped elongated tray by one lid.

The invention summarized above comprises the constructions hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 1:
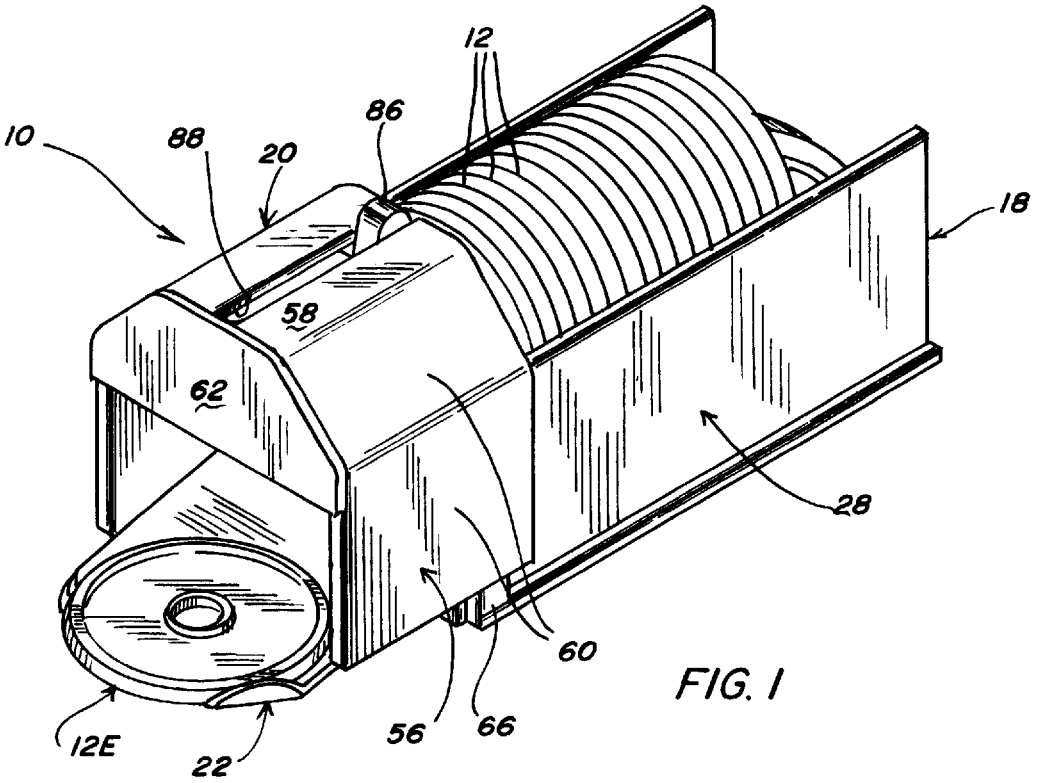
FIG. 1 is a perspective view of a dispenser in accordance with the present invention, with base, hood and dispensing tray assembled.
Figure 2:
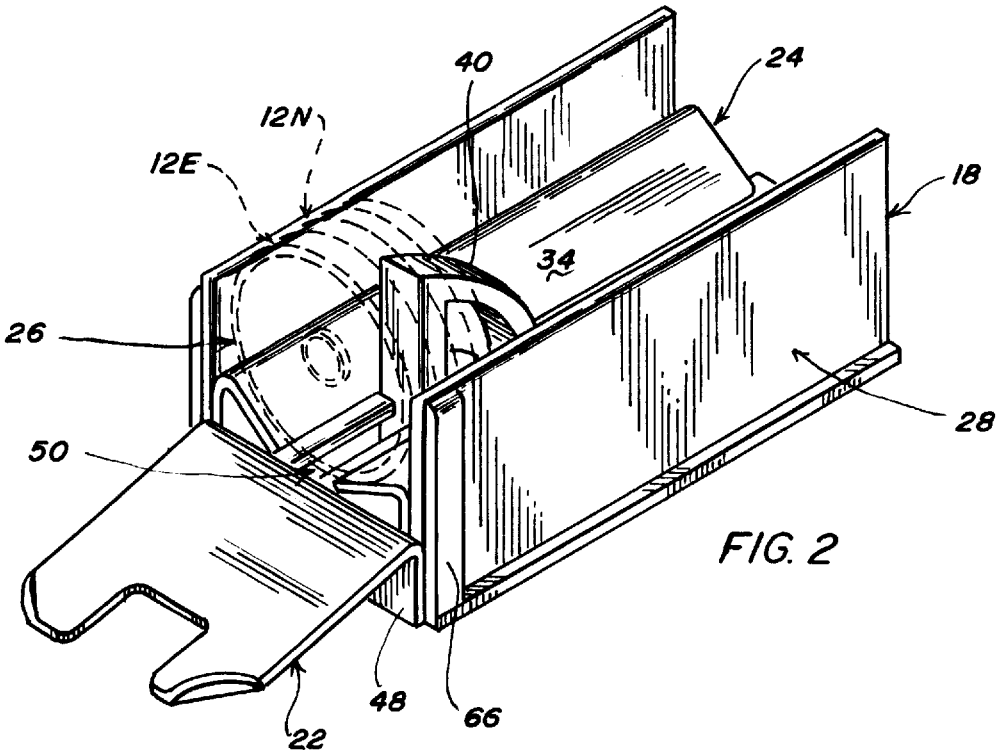
FIG. 2 is a perspective view of a base and dispensing tray.

Referring to the drawings more particularly by reference character, reference numeral 10 refers to a dispenser for serially dispensing disposable lids 12 from a coaxial stack of nested lids in accordance with the present invention. Lids 12 are usually made of plastic and are flexible and self-supporting. Lids 12 are of the type including a circular top wall 14 and an outwardly flared annular flange 16, an endmost lid 12E being partially nested in a next-to-endmost lid 12N and so forth through the stack.

As shown in FIG. 1, dispenser 10 includes a base 18, a hood 20 and dispensing tray 22 into which the lids are serially dispensed. Base 18, as best seen in FIGS. 2–5 and 11, comprises a V-shaped elongated tray 24 with an open dispensing end 26 adapted to receive the stack of lids. In the form illustrated, V-shaped tray 24 is housed in a box-like housing 28 which may be positioned on a counter or mounted within a cabinet. Housing 28 includes a bottom wall 30 and sidewalls 32. V-shaped tray 24 is formed by a pair of opposing elongated channels 34, generally V-shaped in cross-section. Corresponding legs of each channel 34 are attached to opposite sidewalls 32 above bottom wall 30, other corresponding legs of which are angled downwardly, preferably at an angle of about 30 degrees, towards each other, the ends forming the sidewalls of a slot 36.

Figure 3:
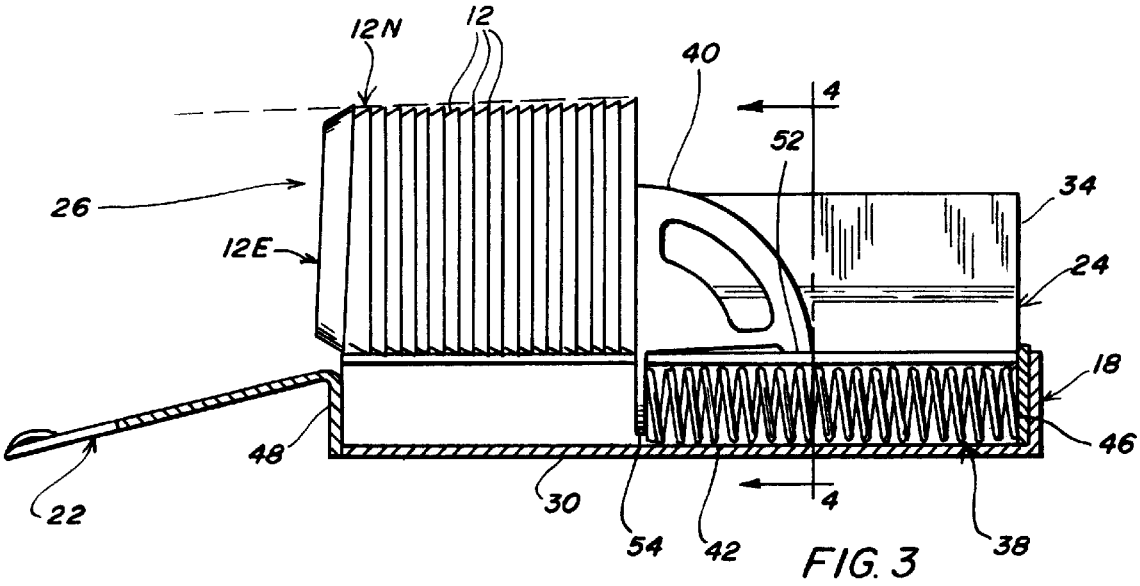
FIG. 3 is a side view of the base and dispensing tray.
Figure 4:
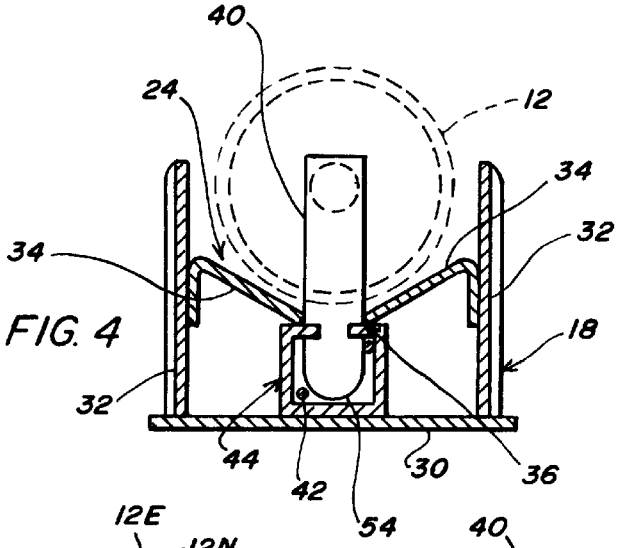
FIG. 4 is a sectional view taken along line 4—4 in FIG. 3 showing a resilient member for biasing the lids in the base towards an open dispensing end.
Figure 5:
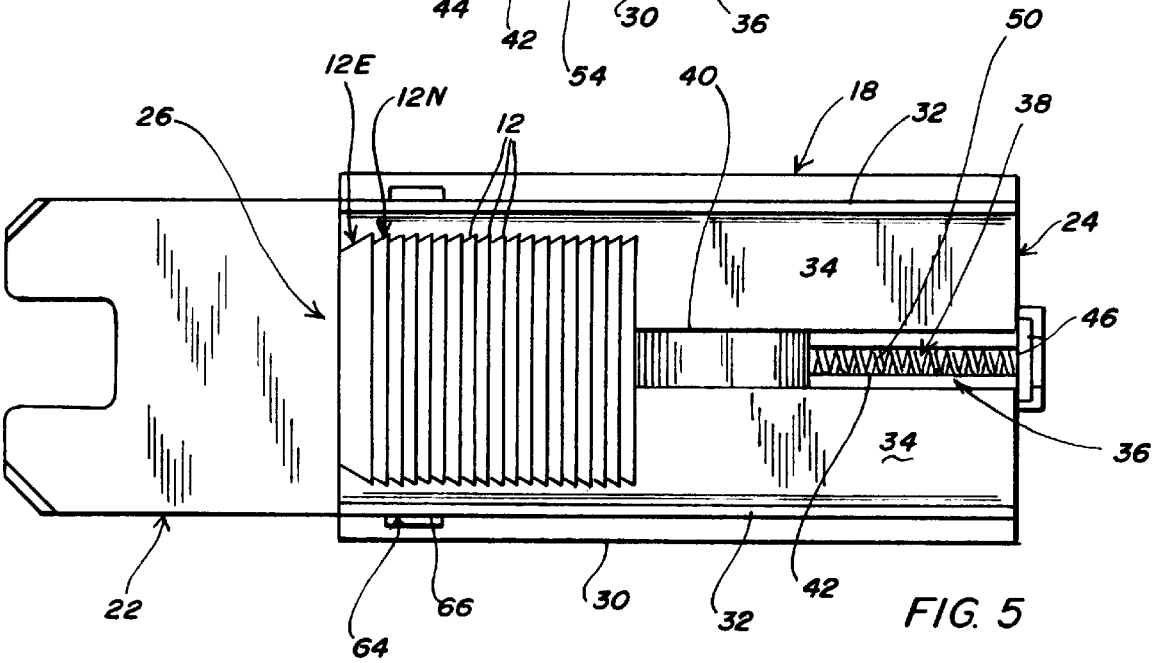
FIG. 5 is a top view of the base and dispensing tray.

A resilient member 38 biasing the lids toward open dispensing end 26 is provided for tray 24. With continuing reference to FIGS. 2–5, resilient member 38 includes a push block 40 and a coiled spring 42. Coiled spring 42 biases push block 40 against the rear of the stack of lids, urging the lids toward the dispensing end of the tray. Coiled spring 42 is confined in an elongated enclosure 44, generally square in cross-section, closed at the rearward end with an end wall 46 and at the opposite end with a leg 48 of dispensing tray 22. Enclosure 44 has a top wall with a slit 50 running the length thereof. Top wall meets with downward angled legs of elongated channels 34 and forms the bottom of slot 36. Push block 40 is triangular in shape when viewed from the side as seen in FIG. 3 with a heel 52 designed to ride in slot 36. As seen in FIG. 4, push block 40 also has a tail 54 which is notched to receive the top wall of enclosure 44 along slit 50. Tail 54 extends into enclosure 44, against which coiled spring 42 is compressed between tail 54 and end wall 46.

Turning now to FIGS. 6–8 and 11, hood 20 is a box-like housing 56 mating with housing 28 of base 18. Housing 56 includes a top wall 58 and sidewalls 60 with an end wall 62 partially closing one end. A groove 64 is provided on the inside of hood housing 56 which is received over a pair of rails 66 provided on the outside of base housing 28 at dispensing end 26 of tray 24 by means of which the hood can be raised and lowered with respect to the base to accommodate different sized lids.

Figure 6:
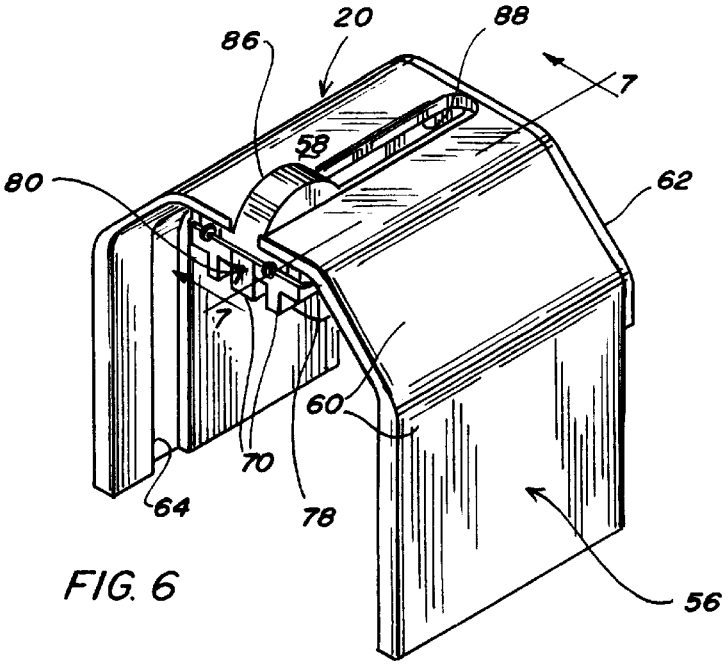
FIG. 6 a perspective view of a hood viewed from the rear.
Figure 7:
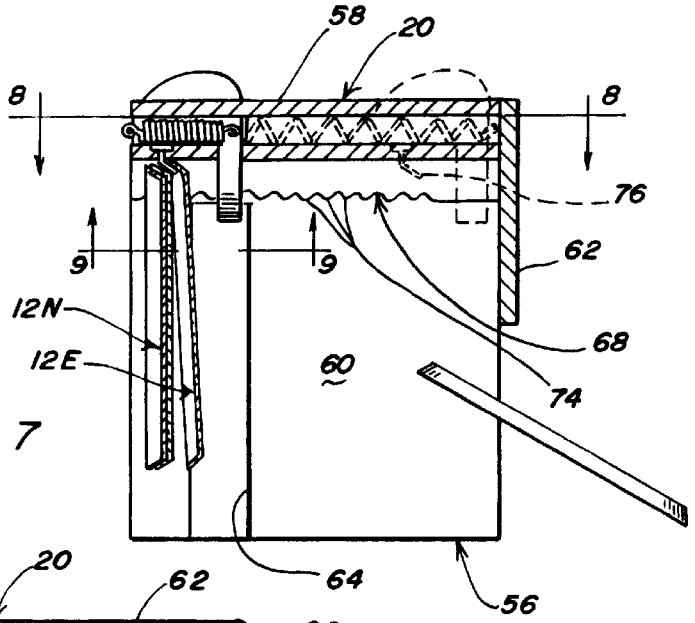
FIG. 7 is a sectional view taken along line 7—7 in FIG. 6 of the hood showing a curved finger followed by a projection mounted on a member reciprocating the finger, shown in full and broken lines.
Figure 8:
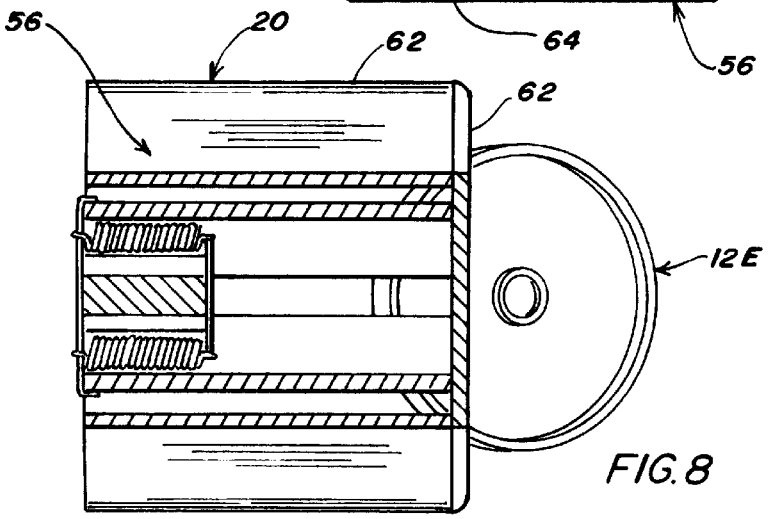
FIG. 8 is a sectional view taken along line 8—8 in FIG. 7 of the hood.
Figure 9A:
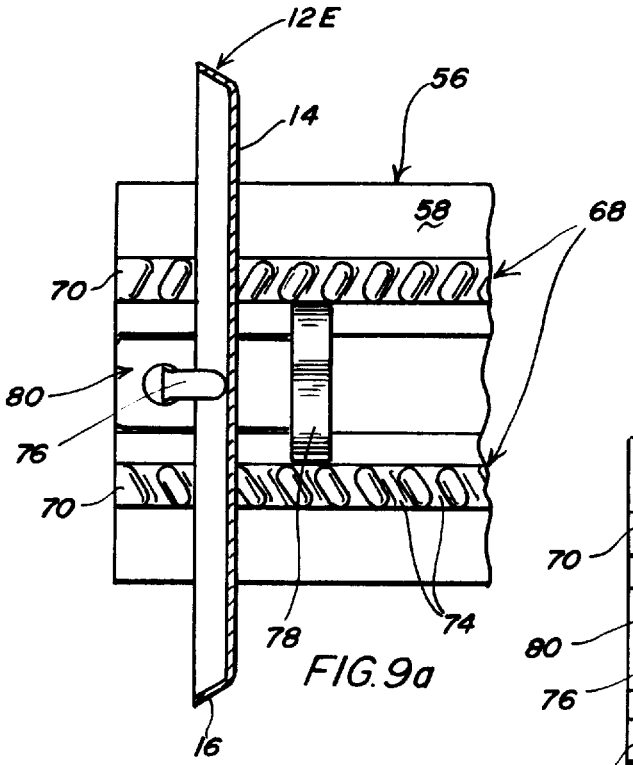
FIGS. 9*a*–9*d* are sectional views taken along line 9—9 in FIG. 7 showing an endmost lid being slid across a pair of spaced apart friction surfaces in process of being dispensed.
Figure 9B:
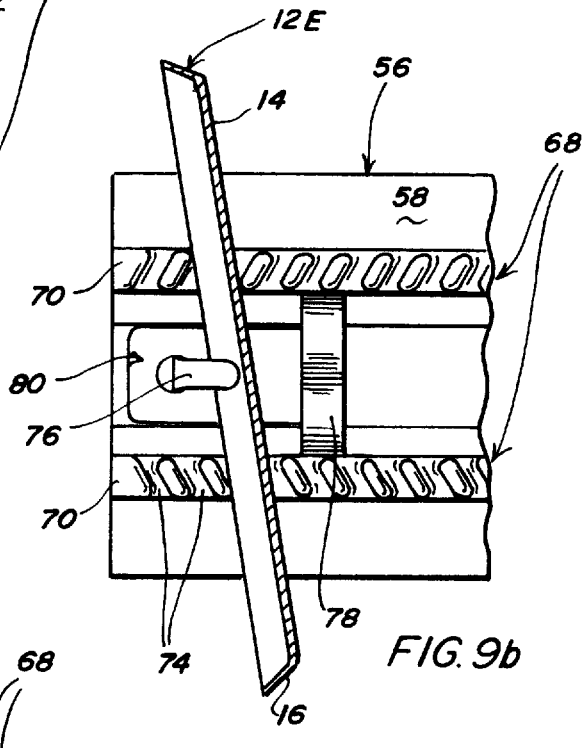
Figure 9C:
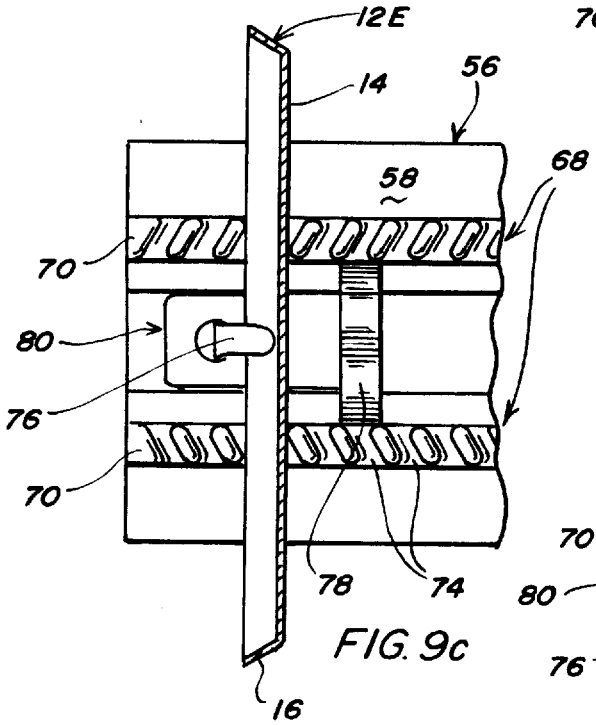
Figure 9D:
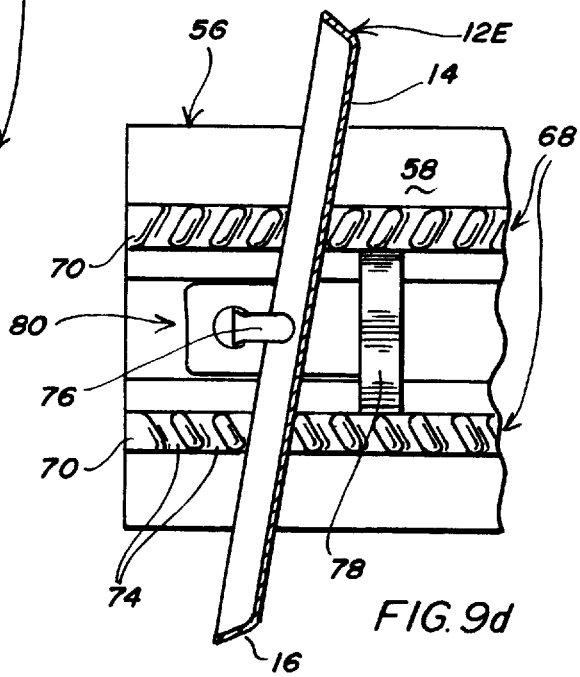
Figures 10, 11:
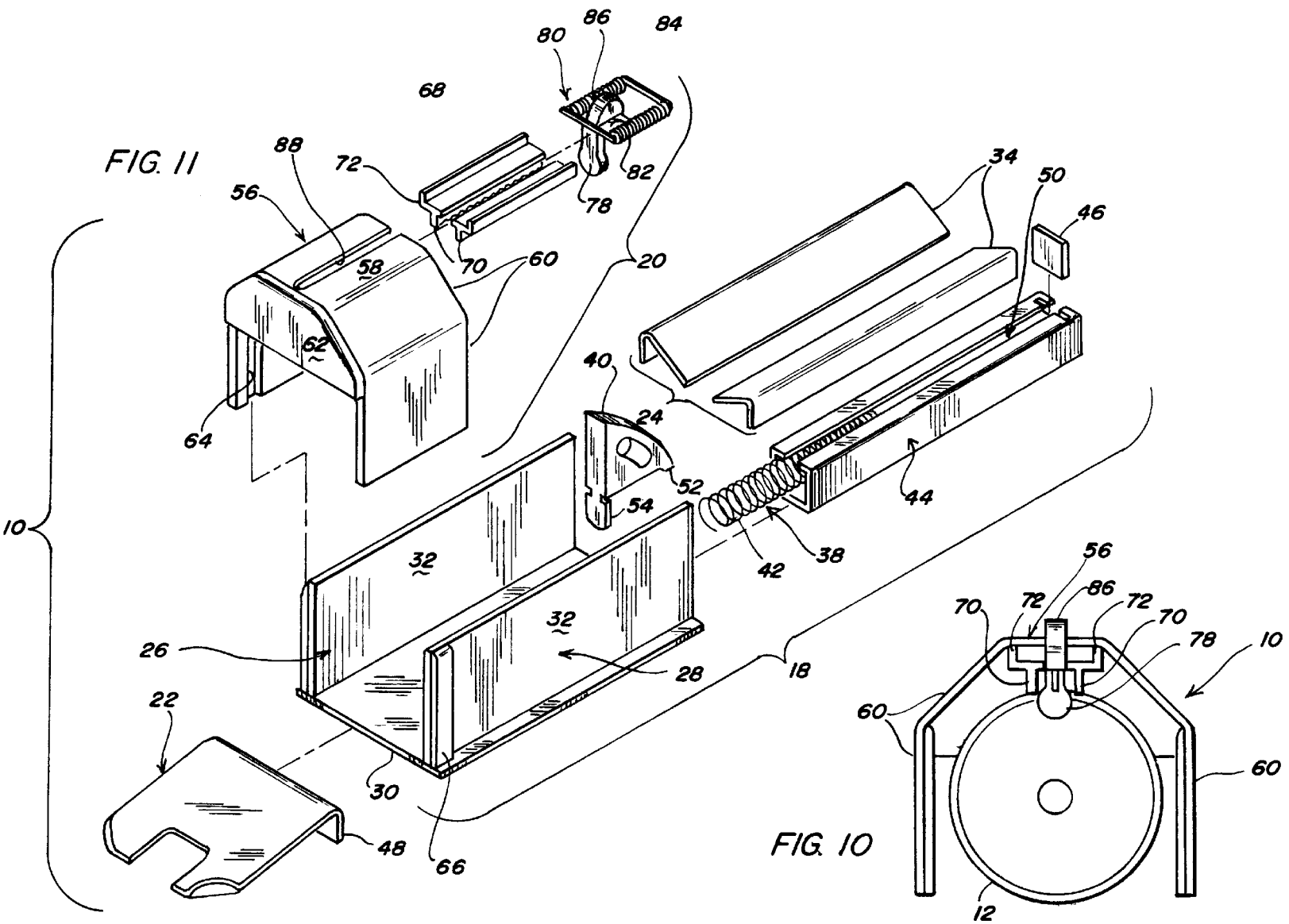
FIG. 10 is an end view of the hood viewed from the rear as in FIG. 6.
FIG. 11 is a perspective exploded view of the dispenser.

A pair of spaced apart elongated friction surfaces 68 are mounted on hood 20 opposing tray 24 at open dispensing end 26. For use with lids ranging in diameter between about 3 and about 6 inches, it is preferred that friction surfaces 68 be spaced apart about one inch. For smaller lids, the spacing can be less and for larger lids, more. Elongated friction surfaces 68 are inclined at a low angle to the stack of nested lids as shown in FIG. 3 and overhang a portion of the tray forming a throat at the open dispensing end through which the lids pass. Very satisfactory results have been obtained when the angle is between about 5 and about 10 degrees, about 7 degrees presently being considered optimum. Elongated friction surfaces tangential contact with the outwardly flared flange 16 of endmost lid and several following lids thereafter as the lids pass through the throat. The friction between elongated friction surfaces 68 and the lids, stop the movement of the stack of lids and causes endmost lid 12E at the end of tray 24, as shown in FIG. 3, to be unlatched from next-to-endmost lid 12N under force of resilient member 38. As best seen in FIGS. 6 and 11, elongated friction surfaces 68 are formed on a pair of rails 70 attached to a pair of L-shaped brackets 72 suspended from the top wall 58. Turning now to FIG. 7 and FIGS. 9*a*–9*d*, elongated friction surfaces 68 on each rail are preferably rope-like with rounded nodes 74, said nodes 74 on the pair of rails angled away from each other in the direction in which endmost lid 12E is moved.

A curved finger 76 followed by a stop 78 is mounted on a member 80 reciprocating the finger and the stop between friction surfaces 68. As the finger is reciprocated towards the stack of lids, finger 76 makes tangential contact with outwardly flared flange 16 of endmost lid 12E, preferably at the same inclined angle of contact as shown in FIG. 3 as a dashed line, overriding and hooking under the flange. Finger 76 is stopped between endmost lid 12E and next-to-endmost lid 12N by stop 78 pressing against the endmost lid. Then as finger 76 is reciprocated away from the stack of lids, finger 76 separates endmost lid 12E from next-to-endmost lid 12N. As endmost lid 12E is slid along friction surfaces 68 as shown in FIGS. 9*a*–9*d*, it wobbles back and forth as it is caught and released by nodes 74 on opposite ones of rails 70. As it passes down rails 66, the rotation of endmost lid 12E is limited by stop 78 which keeps the lid on the finger until separation from next-to-endmost lid 12N is complete. Rails 66 become smooth as they approach end wall 62 of hood, at which point endmost lid 12E slides off finger 76. For this purpose, finger 76 is angled slightly downwardly (see FIG. 7) in the direction of the open bottom of hood housing 56. Stop 78 is illustrated as a lobe pendant from reciprocating member 80.

Reciprocating member 80 comprises a carrier 82 reciprocated in a guideway formed between the top wall of hood housing 56 and L-shaped brackets 72. A pair of springs 84 are attached to opposite sides of carrier 82, biasing the carrier and finger 76 towards the stack of lids, and a knob 86 is attached to the top of the carrier. Knob 86 is accessible through a closed bottom slot 88 in the top of hood housing 56 by which a user can reciprocate carrier 82 and finger 76 in the direction of dispensing tray 22. After endmost lid 12E has dropped, the user releases knob 86, causing carrier to move towards the stack of lids under action of springs 84. When finger 76 reaches the former next-to-endmost lid, finger 76 springs over and behind the next lid, completing a cycle of serial dispensing.

Figure 12:
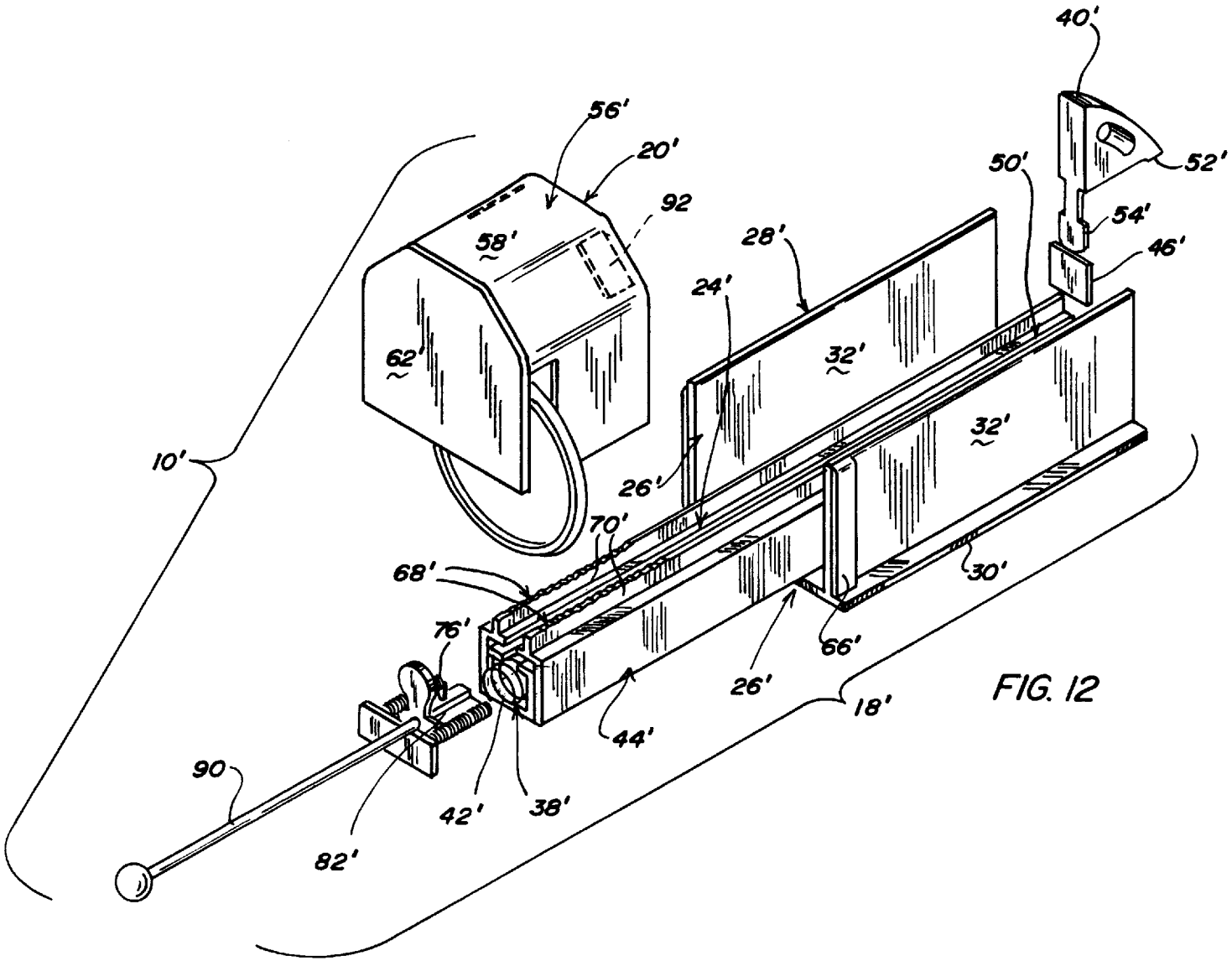
FIG. 12 is an exploded view of a second dispenser in accordance with the present invention.

Dispenser 10 works on the "pull," whereas dispenser 10' shown in FIG. 12 works on the "push." Corresponding parts are given corresponding reference numerals. In this instance, however, a push rod 90 is attached to carrier 82' and an extension of rails 70' forms V-shaped elongated tray 24'. Pads 92 are inclined at a low angle similar to that made by frictions surfaces 68 in dispenser 10 shown in FIGS. 1–11 and together with friction surfaces 68' form a throat through which the stack of lids pass. When the pushrod is pushed towards the nested stack of lids, finger 76' springs over and hooks behind the endmost lid as on the "pull." Part of the energy of the "push" is absorbed by the coiled spring biasing the lids thereby reducing the chance that finger 76' will hook other than the endmost lid. When pressure on pushrod 90 is released, springs 76' reciprocate carrier 82' away from the nested stack of lids, causing the endmost lid to separate from the next-to-endmost lid and then discharging it.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A dispenser adapted for serially dispensing disposable lids from a coaxial stack of nested lids, said lids having a circular top wall and a outwardly flared annular flange, said dispenser comprising a v-shaped elongated tray with an open dispensing end adapted to receive said stack of lids with an endmost lid and a next-to-endmost lid at the open dispensing end, a resilient member biasing the lids toward the open dispensing end, a pair of spaced apart elongated friction surfaces opposing the tray at the open dispensing end, said elongated friction surfaces inclined at an angle to the stack of nested lids and overhanging a portion of the tray forming a throat at the open dispensing end through which the lids pass, said friction surfaces making tangential contact with the outwardly flared annular flange of the endmost lid and several following lids thereafter, said friction surfaces stopping movement of the stack of lids and causing the endmost of said lids to be unlatched from the next-to-endmost lid adjacent the tray at the open dispensing end under force of the resilient member biasing the lids, a curved finger followed by a stop mounted on a member reciprocating the finger and the stop between said friction surfaces, said finger making tangential contact with the outwardly flared flange of the endmost lid and overriding and hooking under the flange when reciprocated towards the stack of nested lids by said reciprocating member, said finger stopped between the endmost lid and the next-to-endmost lid by the stop pressing against the endmost lid, said endmost lid separated from the next-to-endmost lid by the finger when reciprocated away from the stack of nested lids by the reciprocating member, said endmost lid kept on the finger by the stop as the endmost lid is slid along the friction surfaces by the finger until separation of the endmost lid from the next-to-endmost lid is complete whereupon the endmost lid slides off the finger.

2. The dispenser of claim 1 wherein the friction surfaces are rope-like with rounded nodes.

3. The dispenser of claim 2 wherein the friction surfaces are inclined at an angle between about 5 and about 10 degrees to the coaxial stack of nested lids.

4. The dispenser of claim 2 for dispensing lids having a diameter between about 3 and about 6 inches wherein the friction surfaces are spaced apart about 1 inch apart.

5. The dispenser of claim 3 wherein the curved finger is reciprocated at substantially the same angle to the coaxial stack of nested lids as that made by the friction surfaces.

6. A dispenser adapted for serially dispensing disposable lids from a coaxial stack of nested lids, said lids having a circular top wall and a outwardly flared annular flange, said dispenser comprising a v-shaped elongated tray with an open dispensing end adapted to receive said stack of lids with an endmost lid and a next-to-endmost lid at the open dispensing end, a resilient member biasing the lids toward the open dispensing end, said V-shaped elongated tray mounted in a first housing with a bottom wall and sidewalls, a pair of spaced apart elongated friction surfaces opposing the tray at the open dispensing end, said elongated friction surfaces inclined at an angle to the stack of nested lids and overhanging a portion of the tray forming a throat at the open dispensing end through which the lids pass, said friction surfaces making tangential contact with the outwardly flared annular flange of the endmost lid and several following lids thereafter, said friction surfaces stopping movement of the stack of lids and causing the endmost of said lids to be unlatched from the next-to-endmost lid adjacent the tray at the open dispensing end under force of the resilient member biasing the lids, a curved finger followed by a stop mounted on a member reciprocating the finger and the stop between said friction surfaces, said finger making tangential contact with the outwardly flared flange of the endmost lid and overriding and hooking under the flange when reciprocated towards the stack of nested lids by said reciprocating member, said finger stopped between the endmost lid and the next-to-endmost lid by the stop pressing against the endmost lid, said endmost lid separated from the next-to-endmost lid by the finger when reciprocated away from the stack of nested lids by the reciprocating member, said endmost lid kept on the finger by the stop as the endmost lid is slid along the friction surfaces by the finger until separation of the endmost lid from the next-to-endmost lid is complete whereupon the endmost lid slides off the finger, said elongated friction surfaces and the member reciprocating the finger and the stop mounted in a second housing with top wall and sidewalls, said second housing adjustably mating with the first housing for adjusting the size of the throat for lids of different diameters.

7. The dispenser of claim 6 wherein the friction surfaces are rope-like with rounded nodes.

8. The dispenser of claim 7 wherein the friction surfaces are inclined at an angle between about 5 and about 10 degrees to the coaxial stack of nested lids.

9. The dispenser of claim 7 for dispensing lids having a diameter between about 3 and about 6 inches wherein the friction surfaces are spaced apart about 1 inch apart.

10. The dispenser of claim 8 wherein the curved finger is reciprocated at substantially the same angle to the coaxial stack of nested lids as that made by the friction surfaces.

* * * * *